US011459519B2

(12) United States Patent
Grismala

(10) Patent No.: US 11,459,519 B2
(45) **Date of Patent: *Oct. 4, 2022**

(54) ANAEROBIC LUBRICANT SEALANT

(71) Applicant: HENKEL AG & CO, KGaA, Duesseldorf (DE)

(72) Inventor: Roger Grismala, Enfield, CT (US)

(73) Assignee: HENKEL AG & CO, KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/460,595

(22) Filed: Jul. 2, 2019

(65) Prior Publication Data

US 2019/0322957 A1 Oct. 24, 2019

Related U.S. Application Data

(63) Continuation of application No. PCT/US2018/014338, filed on Jan. 19, 2018.

(60) Provisional application No. 62/448,618, filed on Jan. 20, 2017.

(51) Int. Cl.

| | |
|---|---|
| ***C10M 103/02*** | (2006.01) |
| ***C10M 107/04*** | (2006.01) |
| ***C10M 107/38*** | (2006.01) |
| ***C10M 129/16*** | (2006.01) |
| ***C10M 129/72*** | (2006.01) |
| ***C10M 145/14*** | (2006.01) |
| ***C10N 40/34*** | (2006.01) |

(52) U.S. Cl.

CPC ..... *C10M 103/02* (2013.01); *C10M 107/04* (2013.01); *C10M 107/38* (2013.01); *C10M 129/16* (2013.01); *C10M 129/72* (2013.01); *C10M 145/14* (2013.01); *C10M 2201/0413* (2013.01); *C10M 2207/283* (2013.01); *C10M 2209/084* (2013.01); *C10N 2040/34* (2013.01)

(58) Field of Classification Search

CPC ..... C10M 103/02; C10M 107/04; C10M 107/38; C10M 129/16; C10M 129/72; C10M 145/14; C10M 2201/0413; C10M 2207/283; C10M 2209/084; C10M 2201/041; C10M 2201/061; C10M 2201/062; C10M 2201/081; C10M 2201/103; C10M 2201/105; C10M 2205/022; C10M 2205/024; C10M 2207/06; C10M 2207/125; C10M 2207/285; C10M 2209/102; C10M 2209/103; C10M 2209/105; C10M 2213/062; C10M 2215/042; C10M 2215/06; C10M 2219/044; C10M 2223/04; C10M 2223/041; C10M 169/048; C10M 2209/108; C10N 2040/34; C10N 2030/02; C10N 2030/10; C10N 2030/06; C10N 2010/04; C09K 2003/1065; C09K 3/1006; C09K 3/10; C09K 2200/0625; C09J 11/04; C09J 11/06; C09J 133/10; C09J 4/00; C08L 33/10; C08L 33/00; F16B 33/004; F16B 33/06; C08K 3/04; C08K 3/22; C08K 3/36; C08K 5/05; C08K 5/103; C08K 2003/2241; C08K 2003/2237

See application file for complete search history.

(56) References Cited

U.S. PATENT DOCUMENTS

| | | | | |
|---|---|---|---|---|
| 2,065,247 | A | 12/1936 | Smith | |
| 3,007,866 | A | 11/1961 | Chamberlin | |
| 3,114,709 | A | 12/1963 | Chamberlin | |
| 3,218,305 | A | 11/1965 | Krieble | |
| 4,166,169 | A * | 8/1979 | Patel | C09J 4/00 156/332 |
| 4,180,640 | A | 12/1979 | Melody et al. | |
| 4,215,209 | A * | 7/1980 | Ray-Chaudhuri | C09J 4/00 526/215 |
| 4,287,330 | A | 9/1981 | Rich | |
| 4,321,349 | A | 3/1982 | Rich | |
| 4,331,580 | A * | 5/1982 | Bunyan | C09J 4/00 156/294 |
| 4,379,062 | A | 4/1983 | Prengaman | |
| 5,431,831 | A * | 7/1995 | Vincent | C09K 3/10 508/116 |
| 5,498,351 | A | 3/1996 | Hefling | |
| 5,605,999 | A | 2/1997 | Chu et al. | |
| 6,509,394 | B1 * | 1/2003 | Maandi | C09J 4/00 523/176 |
| 6,933,264 | B2 | 8/2005 | Petelot | |
| 7,067,601 | B2 * | 6/2006 | Woods | C08F 20/28 526/315 |
| 7,951,884 | B1 | 5/2011 | Birkett et al. | |
| 8,198,345 | B2 * | 6/2012 | Patel | C09D 133/066 523/176 |
| 8,865,794 | B2 * | 10/2014 | Wallace | B32B 27/32 523/200 |
| 10,526,509 | B2 * | 1/2020 | Ledwith | C09J 4/00 |
| 2004/0127614 | A1 | 7/2004 | Jiang et al. | |

(Continued)

FOREIGN PATENT DOCUMENTS

| | | | | |
|---|---|---|---|---|
| GB | 1013708 A * | 12/1965 | | C09J 4/00 |
| GB | 1094853 A * | 12/1967 | | C08F 265/06 |

(Continued)

OTHER PUBLICATIONS

3M Scotch Weld Stainless Steel High Temperature Sealant (2015) (Year: 2015).*

(Continued)

*Primary Examiner* — Pamela H Weiss
(74) *Attorney, Agent, or Firm* — Sun Hee Lehmann

(57) ABSTRACT

Anaerobic sealant lubricant compositions and uses are disclosed. The anaerobic sealant lubricant compositions cure anaerobically but have lubricity for easy disassembly, making the compositions well suited for fasteners and threaded components.

7 Claims, No Drawings

(56) References Cited

U.S. PATENT DOCUMENTS

| | | | | |
|---|---|---|---|---|
| 2005/0154141 | A1* | 7/2005 | Attarwala | C09J 9/005 525/242 |
| 2017/0051188 | A1* | 2/2017 | Fujii | C09J 7/10 |
| 2017/0334173 | A1* | 11/2017 | Yui | B32B 17/10559 |
| 2018/0117883 | A1* | 5/2018 | Olson | B32B 27/30 |

FOREIGN PATENT DOCUMENTS

| | | | | | |
|---|---|---|---|---|---|
| GB | 1106449 | A | * | 3/1968 | C09J 4/00 |
| GB | 1523681 | A | * | 9/1978 | C09J 4/00 |
| WO | 99/01484 | A1 | | 1/1999 | |
| WO | 2009/064851 | A2 | | 5/2009 | |
| WO | WO-2016076336 | A1 | * | 5/2016 | B32B 17/10036 |

OTHER PUBLICATIONS

Rich, Richard D. "Anaerobic Adhesives," Handbook of Adhesive Technology, ed. Pizza, A and Mittal, K.L., Marcel Dekker, Inc., Chapter 2, 1994, pp. 467-479.

* cited by examiner

ANAEROBIC LUBRICANT SEALANT

FIELD OF THE INVENTION

The present invention relates to anaerobic lubricant sealant compositions. More particularly the invention relates to compositions that cures anaerobically but allows lubricity for easy disassembly, making these compositions particularly well suited for fasteners and threaded components.

BACKGROUND OF THE INVENTION

Anaerobic adhesives and sealants are often used in fasteners and joints of heavy equipment to prevent loosening from vibration and also to protect the joints from corrosion or rust that can result from moistures. Anaerobic adhesive compositions generally are well-known. See e.g., R. D. Rich, "Anaerobic Adhesives" in *Handbook of Adhesive Technology,* 29, 467-79, A. Pizzi and K. L. Mittal, eds., Marcel Dekker, Inc., New York (1994), and references cited therein. Their uses are legion and new applications continue to be developed.

Conventional anaerobic adhesives ordinarily include a free-radically polymerizable acrylate ester monomer, together with a peroxy initiator and an inhibitor component. Many times, such anaerobic adhesive compositions also contain accelerator components to increase the speed with which the composition cures.

Desirable anaerobic cure-inducing compositions to induce and accelerate cure may include saccharin, toluidines, such as N,N-diethyl-p-toluidine ("DE-p-T") and N,N-dimethyl-o-toluidine ("DM-o-T"), acetyl phenylhydrazine ("APH"), maleic acid, and quinones, such as napthaquinone and anthraquinone. See e.g., U.S. Pat. No. 3,218,305 (Krieble), U.S. Pat. No. 4,180,640 (Melody), U.S. Pat. No. 4,287,330 (Rich) and U.S. Pat. No. 4,321,349 (Rich).

Over time, the joints are replaced for an interchangeable part or for damage; however, disassembling the fasteners from the equipment can be time consuming, expensive or even dangerous. Lubricity is desired for these applications, but conventional fasteners and joints fall short, particularly in terms of clamp load. Insufficient clamp load means that a higher torque is required for disassembling fasteners and assembling joints. Higher torque may go beyond the manufactures' recommended specification.

Lubricants reduce torque-tension scatter as the joints are assembled and disassembled. The residues of the lubricants remaining on the fasteners reduce friction and prevents galling of the joints. U.S. Pat. No. 5,498,351 claims a process for making anti-seize lubricant compositions, and sets forth compositions of this type which include naphthenic oil, lubricating grease, graphite, silicon fluid, and metal flake/oil suspension (65% aluminum flake and 35% oil).

Over time, mineral and corrosion and water effectively washes away and depletes the lubricants and disassembly of the fasteners becomes challenging. Again, disassembling the fasteners from the equipment can be time consuming, expensive and/or dangerous. While U.S. Pat. No. 8,198,345 teaches lubricious anaerobic curable composition, the shear strength, after curing, is high.

There is a need in the art for materials that possesses good sealing and lubricating performances for fasteners that allow for good bonding and yet allows for disassembly of the fasteners. The current invention fulfills this need.

BRIEF SUMMARY OF THE INVENTION

The present invention relates to an anaerobic sealant lubricant composition and articles of manufacture comprising the anaerobic sealant lubricant composition.

One aspect of the invention is directed to an anaerobic sealant lubricant composition comprising an acrylate, a plasticizer, a lubricant, a curing agent, and a rheology modifier.

Another aspect of the invention is directed to an anaerobic sealant lubricant composition comprising an acrylate, a plasticizer, a lubricant, a curing agent, and a rheology modifier, wherein the ratio of the acrylate to the plasticizer ranges from about 1:1 to about 1:4.

In yet another aspect, the invention is an anaerobic sealant lubricant composition comprising an acrylate, a plasticizer, a lubricant, a curing agent, and a rheology modifier, having a lubricity of 0.2 K-factor or less as measured by ASTM D5648-01 and a breakaway torque strength of about 1 to about 3 Nm as measured by ASTM D5649 after aging at room temperature cure for two weeks and after aging at higher temperature.

In another aspect, the methods of preparing and using the inventive anaerobic lubricant systems, as well as reaction products of the inventive anaerobic curable compositions, are further disclosed.

Articles of manufacture encompassed by the invention include fasteners and joints, both threaded and non-threaded surfaces.

The addition of the plasticizer in a specific ratio, along with the addition of lubricants surprisingly provides at least comparable sealing strength for the joints while also allowing for lower torque during the removal of the joints.

DETAILED DESCRIPTION OF THE INVENTION

The present invention provides curable anaerobic lubricant sealant composition. In the present invention, the anaerobic lubricant sealant compositions provide decreased torque required at a pre-determined tension.

The anaerobic lubricant sealant composition comprises an acrylate, a plasticizer, a lubricant, a curing agent and a rheology modifier.

(Meth)acrylate monomers suitable for use as the (meth) acrylate component in the present invention may be chosen from a wide variety of materials, such as these represented by $H_2C{=}CGCO_2R^1$, where G may be hydrogen, halogen or alkyl groups having from 1 to about 4 carbon atoms, and $R^1$ may be selected from alkyl, cycloalkyl, alkenyl, cycloalkenyl, alkaryl, aralkyl or aryl groups having from 1 to about 16 carbon atoms, any of which may be optionally substituted or interrupted as the case may be with silane, silicon, oxygen, halogen, carbonyl, hydroxyl, ester, carboxylic acid, urea, urethane, carbonate, amine, amide, sulfur, sulfonate, sulfone and the like.

Additional (meth)acrylate monomers suitable for use herein include polyfunctional (meth)acrylate monomers, such as, but not limited to, di- or tri-functional (meth) acrylates like polyethylene glycol di(meth)acrylates, tetrahydrofuran(meth)acrylates and di(meth)acrylates, hydroxypropyl(meth)acrylate ("HPMA"), hexanediol di(meth) acrylate, trimethylol propane tri(meth)acrylate ("TMPTMA"), diethylene glycol dimethacrylate, triethylene glycol dimethacrylate ("TRIEGMA"), tetraethylene glycol dimethacrylate, dipropylene glycol dimethacrylate, di-(pentamethylene glycol) dimethacrylate, tetraethylene diglycol diacrylate, diglycerol tetramethacrylate, tetramethylene dimethacrylate, ethylene dimethacrylate, neopentyl glycol diacrylate, trimethylol propane triacrylate and bisphenol-A mono and di(meth)acrylates, such as ethoxylated bisphenol-A (meth)acrylate ("EBIPMA"), and bisphenol-F mono and di(meth)acrylates, such as ethoxylated bisphenol-F (meth)acrylate.

Still other (meth)acrylate monomers that may be used herein include silicone(meth)acrylate moieties ("SiMA"), such as those taught by and claimed in U.S. Pat. No. 5,605,999 (Chu), the disclosure of which is hereby expressly incorporated herein by reference.

Combinations of these (meth)acrylate monomers may also be used.

The (meth)acrylate component should comprise from about 5 to about 55 percent by weight of the composition, such as about 5 to about 20 percent by weight, based on the total weight of the composition.

Recently, additional components have been included in traditional anaerobic curable compositions to alter the physical properties of either the curable compositions or the reaction products thereof.

For instance, one or more of maleimide components, thermal resistance-conferring coreactants, diluent components reactive at elevated temperature conditions, and mono- or poly-hydroxyalkanes, (see WO 99/01484, the disclosure of which is hereby expressly incorporated herein by reference) may be included to modify the physical property and/or cure profile of the formulation and/or the strength or temperature resistance of the cured adhesive.

When used, the maleimide, coreactant, reactive diluent, and/or mono- or poly-hydroxyalkanes, may be present in an amount within the range of about 0.01 percent to about 2 percent by weight, based on the total weight of the composition.

Suitable plasticizers for use in the present invention may be chosen from a wide variety of materials, such as phthalate-based, adipate-based plasticizers, including trimelliates, maleates, organophosphates and glycol/polyethers. A particularly suitable plastcizer is tetraethylene glycol dioctanoate.

The plasticizer component should comprise from about 5 to about 80 percent by weight of the composition, such as about 10 to about 40 percent by weight, based on the total weight of the composition.

To balance the properties of the strong adhesion and anti-galling and lubricity, the ratio of the (meth)acrylate monomer component to the plasticizer component should be in the range of about 1:1 to about 1:4.

Lubricants may be selected from graphite, calcium oxide, calcium carbonate, calcium fluoride, calcium stearate, magnesium oxide, magnesium carbonate, magnesium fluoride, magnesium stearate, boron nitride, polyethylene, polypropylene, polytetrafluoroethylene, organophosphate, and combinations thereof. A particularly desirable combination includes graphite, polytetrafluoroethylene and polyethylene.

Commercially available examples and specifications of such lubricious agents include those from TEFLON, tricresyl phosphate under the tradename LINDol by Akzo Nobel, Superior Graphite under the trade designation Graphite 5539 (particle size: 90% minimum, 20 micron, Ash: 02%, max); Mississippi Lime under the tradename QUICK LIME (fine white powder, particle size 325 mesh or lower); Pluss Staufer under the tradename ATOMFOR S (particle size: 99% smaller than 325 mesh, specific gravity: 2.71); Seaforth Mineral under the tradename FLUORSPAR SUPERFINE (specific gravity: 3.81, solubilityin water: 16 mg/l); Witco, under the trade designation name Calicum Stearate Regular (white powder, slightly fatty odor, melting point: 106° C., specific gravity: 1.03); Kyowa Chemical under the tradename PYROKISMA 530 IJ (white powder, MgO: 93.8, heat loss: 0.930); Dolomia Ltd under the tradename DOLOMITA #325 TB (particle size 325 mesh); Spectrum Chemical as magnesium fluoride (particle size: 325 mesh); CP Hall as magnesium stearate (white powder, specific gravity: 1.028, particle size: 325 mesh); Advanced Ceramics under the trade designation Boron Nitride HCP GRADE (particle size: 7-10 micron, 99% passes through 325 mesh, density: 0.4 g/cc, moisture: 0.15%); Equistar Chem under the tradename MICROTHENE FN-510 (fine powder, particle size: 15% max, retained 270 mesh); Eastman Chemical under the tradename POLENE N-15 WAX (white solids, specific gravity: 0.62); and DuPont under the tradename ZONYL MP 1300 (specific gravity: 2.1-2.3). Also, useful lubricious agents include petroleum distillates, 1-10% Chemplex FP-1 and Severly Hydrotreated Heavy Naphthenic D (Mineral Oil) 1-10% Hygold H100.

The lubricant component should comprise from about 1 to about 55 percent by weight of the composition, such as about 1 to about 30 percent by weight, based on the total weight of the composition.

The inventive compositions may also include other conventional components, such as free radical initiators, other free radical co-accelerators, inhibitors of free radical generation, as well as metal catalysts, such as iron and copper.

A number of well-known initiators of free radical polymerization are typically incorporated into the inventive compositions including, without limitation, hydroperoxides, such as CHP, para-menthane hydroperoxide, t-butyl hydroperoxide ("TBH") and t-butyl perbenzoate. Other peroxides include benzoyl peroxide, dibenzoyl peroxide, 1,3-bis(t-butylperoxyisopropyl)benzene, diacetyl peroxide, butyl 4,4-bis(t-butylperoxy)valerate, p-chlorobenzoyl peroxide, cumene hydroperoxide, t-butyl cumyl peroxide, t-butyl perbenzoate, di-t-butyl peroxide, dicumyl peroxide, 2,5-dimethyl-2,5-di-t-butylperoxyhexane, 2,5-dimethyl-2,5-di-t-butyl-peroxyhex-3-yne, 4-methyl-2,2-di-t-butylperoxypentane and combinations thereof.

Such peroxide compounds are typically employed in the present invention in the range of from about 0.1 to about 10 percent by weight, based on the total weight of the composition, with about 1 to about 5 percent by weight being desirable.

Conventional accelerators of free radical polymerization may also be used in conjunction with the inventive anaerobic cure accelerators. Suitable accelerators include saccharine, N, N-diethyl-p-toluidine, N, N-diemethyl-p-toluidine. Other suitable co-accelerators are typically of the hydrazine variety (e.g., APH), as disclosed in the '330 and '349 patents.

Anaerobic cure accelerators may be used in amounts of about 0.1 to about 5 percent by weight, such as about 1 to about 2 percent by weight, based on the total weight of the composition. When used in combination with conventional accelerators (though at lower levels, for such conventional accelerators), the inventive accelerators should be used in amounts of about 0.01 to about 5 percent by weight, such as about 0.02 to about 2 percent by weight.

Stabilizers and inhibitors (such as phenols including hydroquinone and quinones) may also be employed to control and prevent premature peroxide decomposition and polymerization of the composition of the present invention, as well as chelating agents [such as the tetrasodium salt of ethylenediamine tetraacetic acid ("EDTA")] to trap trace amounts of metal contaminants therefrom. When used, chelators may ordinarily be present in the compositions in an amount from about 0.1 percent by weight to about 5 percent by weight, based on the total weight of the composition.

Rheology modifiers such as thickeners and fillers and other well-known additives may be incorporated therein where the art-skilled believes it would be desirable to do so. Suitable rheology modifiers include propoxylated bisphenol-A fumarate, bisphenol-A fumarate polyester resin, mica, and fumed silica.

The sealant compositions of the present invention may be prepared using conventional methods which are well known to those persons of skill in the art. For instance, the components of the inventive compositions may be mixed together in any convenient order consistent with the roles and functions the components are to perform in the compositions. Conventional mixing techniques using known apparatus may be employed.

The compositions of this invention may be applied to a variety of substrates to perform with the desired benefits and advantages described herein. For instance, appropriate substrates may be constructed from steel, brass, copper, aluminum, zinc, glass and other metals and alloys. The compositions of this invention demonstrate particularly good bond strength on steel, brass, bronze, copper and iron. An appropriate primer may be applied to a surface of the chosen substrate to enhance cure rate.

In addition, this invention provides a method of preparing an anaerobic lubricant sealant composition, a step of which includes mixing together a (meth)acrylate component, plasticizer, and an anaerobic cure-inducing composition with a lubricant agent.

The invention also provides a process for preparing a reaction product from the anaerobic adhesive composition of the present invention, the steps of which include applying the composition to a desired substrate surface and exposing the composition to an anaerobic environment for a time sufficient to cure the composition.

Once cured, the anaerobic lubricant sealant provides strong adhesion and the joints have torque strength of at least about 10% over the original torque assembly strength at 1 Wk room temperature (8-28° C.). The anaerobic lubricant sealant prevents metal-to-metal contact, and fills all the small depressions, dents and imperfections in the joint, and gives a firm positive seal and keeps the metals-to-metal apart to prevent galling.

In addition, the high viscosity of the inventive anaerobic lubricant sealant remains within the threads of the joints thread corrosion. The sealant prevents dirt, water, salt, sand and dust particles from entering in between the joint threads.

The breakaway torque strength is a nut and bolt diassmble test, where a nut is turned three threads down the bolt. Breakloose utilizes a spacer and the nut is tightened all the way down the bolt to the spacer at the base of the bolt and then torque-wrench tightened.

The joints, from time to time, need to be separated due to damage, maintenance or to replace a part. Breakaway and breakloose torque strength are two tests that measures the force required to loosen the bond between the nut and bolt. The joints can be separated with lower breakloose torque strength than conventional anaerobic sealant due to the improved lubricity K-factor (torque coefficient). K-factor is measured as K=T/DF, where K is the friction constant, T is applied toque in Nm, D is nominal diameter of bolt in meters and F is bolt tension in N. The breakaway strength of about 1 to about 3 Nm as measured by ASTM D5649 after aging at room temperature cure for two weeks and after aging at higher temperature.

Articles of manufacture encompassed by the invention include fasteners and joints, both threaded and non-threaded surfaces, and particularly for threaded surfaces. Examples include, bolts, nuts, screws, rods and studs.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

EXAMPLES

Examples 1. Anaerobic Lubricant Sealant Formulation A

TABLE 1

| Component | Compound | Amt./ wt % |
|---|---|---|
| (Meth)acrylate | Polyethylene Glycol Dimethacrylate | 10 |
| Plasticizer | Tetraethyleneglycol dioctanoate | 29.5 |
| | Tricresylphosphate | 10 |
| Lubricant | Graphite | 8.6 |
| | Teflon | 18 |
| Curing agent | Stabilizer - Naphoquinone premix | 1 |
| | Chealter - EDTA | 2.5 |
| | Curing initator - Cumene | 1 |
| | hydroperoixde | 1 |
| | Accelerator - Saccharine | 0.1 |
| | Accelerator - N,N-diethyl-p-toluidine | 0.05 |
| | Accelerator - N,N-dimethyl-p-toluidine | |
| Rheology modifier | Propylated bisphenol A fumerate | 8.75 |
| | Mica | 7.5 |
| | Fumed silica | 2 |

Sealant Formulation A was prepared by combining all of the components in Table 1 in an Air mixer with stainless steel Cowles/Sawblade impeller for 1.5 hours at room temperature. The mixed Sealant Formulation A was stored at room temperature.

The physical properties were measured for the Sealant Formulation A and a comparative SEALUBE from Hunting, an anaerobic sealant are listed in Table 2.

TABLE 2

| Property | SEALUBE | Sealant Formulation A |
|---|---|---|
| Viscosity Brookfield, 2 min, 1 spd #7 (cPs) | * | 174,000 |
| Viscosity Brookfield, 20 min, 1 spd #7 (cPs) | * | 99,400 |
| Viscosity Physica PP20 1 mil gap 5 | 644,000 | 2,930 |
| Thixotropic ratio | N/A** | 1.8 |
| Lubricity TS106/107 | 0.13 | 0.15 |
| Stability test tube at 82° C. | 3-4 hour | 2-3 hours |

* Measured with Brookfield with Helipath Instrument HBT 22C speed rotation 0.5 min-1, 2, 160,000 cPs.
**Only tested at one speed.

The Sealant Formulation A's physical properties are comparative to SEALUBE, except the viscosity is significantly lower. Both samples had low Lubricity (K-factors), less than 2.0 and stable for at least 2-3 hours at 82° C.

Brookfield Viscosity of the Sealant Formulation A was measured with spindle #7 at the corresponding times at 22° C., in accordance with ASTM D1084. The SEALUBE viscosity was not measurable with the same spindle.

Physica Viscometer PP20, with setting of 1 mil gap, 0.5 speed, was used measure the viscosity.

The thixotropic ratio was calculated by dividing the slower speed by the higher speed.

The lubricity test was conducted in accordance with ASTM D5648.

Torque strength, breakaway torque and breakloose torque, of adhesives were measured in accordance with ASTM D 5649, titled, "Torque Strength of Adhesives used on Threaded Fasteners."

Breakaway torque is the torque necessary to put into reverse rotation an unseated nut that has been assembled by hand over at least three threads of the bolt's bonded area. Both the nut and bolt had a size of ⅜"×24" steel (grade 2).

Breakloose torque measure the torque required to effect reverse rotation when a pre-stressed threaded assembly is loosened. The torque was measured at room temperature or at room temperature after exposure to 177° C. A hardened washer was placed over the exposed end of the bolt unit it squarely contacted the bearing surface of the device. The nut was assembled onto the bolt until it contacted the hardened washer. The nut was tightened with a calibrated torque wrench to 5 Nm for this test. The force required to loosen the bond between the bolt thread and the nut was recorded.

The stability test was measured on a 10×75 mm VWR glass test tube with a VWR Digital Heatblock set at 82° C. Stability hours were recorded at the time required for the formulation to begin to polymerize or gel. The test was conducted with a wooden applicator stick.

Example 2. Breakloose Torque

The Sealant Formulation A was then applied onto a ⅜"×16 phosphate and oil coated streel grade 2 nut and bolt, and aged in accordance with Table 2. The substrate was pre-torqued to 5 Nm and tested at 22° C. KRYOX RFE Lubricant (PFPE High Performance Lubricant) from CHEMOURS was also tested for comparative purpose.

TABLE 3

| Heat Aged Breakloose Torque | KRYOX | Sealant Formulation A |
|---|---|---|
| 72 hours at 22° C. | 4.0 Nm | 5.1 Nm |
| 72 hours at 177° C. | 4.7 Nm | 8.3 Nm |

Sealant Formulation A had higher breakloose torque than KRYOX lubricant. This was true even under elevated temperature aging condition. The Sealant Formulation A had higher strength than KRYTOX.

The Sealant Formulation A is applied onto a ⅜"×16 phosphate and oil coated steel grade 2 nut and bolt. The samples were heat aged in accordance with Table 3. Pre-torque of 5 Nm was added. SEALUBE was also tested for comparative purpose.

TABLE 4

| Heat Aged Breakloose | SEALUBE | Sealant Formulation A |
|---|---|---|
| 168 hours at 22° C. | 6.8 Nm | 5.5 Nm |
| 168 hours at 22° C., 24 hours at 177° C. | 13.3 Nm | 7.7 Nm |

TABLE 4-continued

| Heat Aged Breakloose | SEALUBE | Sealant Formulation A |
|---|---|---|
| 168 hours at 22° C., 168 hours at 177° C. | 18.4 Nm | 10.4 Nm |
| 168 hours at 22° C., 1008 hours at 177° C. | 24.2 Nm | 14.4 Nm |

The clamping load was measured after the sealants were exposed to elevated temperatures. Upon exposure to higher temperatures, the breakloose torque increases significantly for SEALUBE. Sealant Formulation A, however, has lower breakloose, which allows for dissasembly even if the sealants are exposed to elevated temperatures.

Example 3. Breakaway Torque

Breakaway torque was measured for the Sealant Formuation A. This was tested on nus and bolts, having a size of ⅜"×24" steel (grade 2), without any phosphate and oil was. The samples were cured at various temperatures and times, as noted in the Table 5, and the breakaway torque was tested at room temperature.

TABLE 5

| Breakaway Torque (conditioned) | SEALUBE | Sealant Formulation A |
|---|---|---|
| room temperature for 24 hours | 1.7 Nm | 0.9 Nm |
| 93° C. for 24 hours | 12.8 Nm | 2.0 Nm |
| Room temperature for 1 week | — | 1.3 Nm |
| Room temperature for 2 weeks | — | 2.1 Nm |

The breakaway torque of the Sealant Formulation, even after heating or two weeks remained under 3 Nm.

Example 4. Pin and Collar Test

Pin and Collar test was conducted on the Sealant Formulation A and the lubricious anaerobic sealant formulation listed in U.S. Pat. No. 8,198,345. The reference made to U.S. Pat. No. 8,198,345 for a general discussion of the lubricious anaerobic sealant and their strength are hereby expressly incorporated by reference.

TABLE 6

| Pin and Collar Test | Lubricous Anaerobic Sealant made in accordance with U.S. Pat. No. 8,198,345 | Sealant Formulation A |
|---|---|---|
| 1 hour | 7.2 Nm | 0.10 Nm |
| 42 hours | 18.9 Nm | 0.58 Nm |

The lubricious anaerobic sealant formulation of U.S. Pat. No. 8,198,345 had far greater Pin and Collar strength than the Sealant Formulation A. In contrast, the Sealant Formulation A has significantly lower pin and collar value, even after 42 hours.

Example 5. Breakaway Torque after Water Submersion

Samples were coated onto ⅜"×16" phosphate and oil coated steel (grade 2) nut and bolt, and cured in accordance with the Table 7. They were then place in a plastic bottle, filled with water, and then shaken for 5 hours.

TABLE 7

| Heat Aged Breakloose Torque | KRYTOX | Sealant Formulation A |
|---|---|---|
| 72 hours at 22° C. | 4.2 Nm | 5.2 Nm |
| 72 hours at 177° C. | 4.6 Nm | 8.2 Nm |

This test simulated weathering, submersion and agitation in water, and Sealant Formulation A remained in the nut and bolt, and still had higher strength than the comparative sample.

I claim:

1. An anaerobic sealant lubricant composition comprising:

a) about 5 to 20 wt % of an acrylate selected from the group consisting of polyethylene glycol di(meth)acrylates, tetrahydrofuran(meth)acrylates and di(meth) acrylates, hydroxypropyl(meth)acrylate, hexanediol di(meth)acrylate, trimethylol propane tri(meth)acrylate, diethylene glycol dimethacrylate, triethylene glycol dimethacrylate, tetraethylene glycol dimethacrylate, dipropylene glycol dimethacrylate, di-(pentamethylene glycol) dimethacrylate, tetraethylene diglycol diacrylate, diglycerol tetramethacrylate, tetramethylene dimethacrylate, ethylene dimethacrylate, neopentyl glycol diacrylate, trimethylol propane triacrylate, ethoxylated bisphenol-A (meth)acrylate, ethoxylated bisphenol-F (meth)acrylate, and mixtures thereof;

b) about 5 to about 40 wt % of a plasticizer selected from the group consisting of tetraethylene glycol dioctanoate, trimelliates, maleates, organophosphates, glycol, polyether, and mixtures thereof;

c) about 18 to about 70 wt % of a lubricant, selected from the group consisting of graphite, polytetrafluoroethylene, polyethylene, and mixtures thereof, d) about 0.2 to about 10 wt % of a curing agent; and e) about 2 to about 40 wt % of a rheology modifier; and wherein the ratio of the acrylate to the plasticizer ranges from about 1:1 to about 1:4 wherein the composition has a lubricity value of 0.2 K-factor or less as measured by ASTM D5648-01; and wherein the composition has a breakaway torque strength of about 1 to about 3 Nm as measured by ASTM D5649 after aging at room temperature cure for two weeks.

2. The anaerobic sealant lubricant composition of claim 1, wherein the plasticizer is a mixture of tetraethylene glycol dioctanoate and organophosphates.

3. The anaerobic sealant lubricant composition of claim 1, wherein the curing agent is a free radical initiator, free radical co-accelerator, an inhibitor, a free radical stabilizer or a chelator.

4. The anaerobic sealant lubricant composition of claim 1, wherein the rheology modifier is propoxylated bisphenol-A fumarate, bisphenol-A fumarate polyester resin, mica or fumed silica.

5. An article of manufacture comprising the anaerobic sealant lubricant composition of claim 1.

6. The article of claim 5, which is a fastener.

7. The article of claim 6, wherein the fastener is nuts, bolts, rods, pins, collars, studs, pipes, and anchor.

* * * * *